United States Patent [19]

Bichon

[11] Patent Number: 4,934,640

[45] Date of Patent: Jun. 19, 1990

[54] PORTABLE CONTAINER FOR SOAP

[76] Inventor: Russel Bichon, 50 Laval Drive, Winnipeg, Manitoba, Canada, R3T 2X7

[21] Appl. No.: 355,318

[22] Filed: May 23, 1989

[51] Int. Cl.[5] ..... F16B 47/00

[52] U.S. Cl. ..... 248/206.2; D6/537; 206/77.1; 248/311.2

[58] Field of Search ..... 248/206.2, 206.3, 311.2, 248/683; 211/88; D6/537; 206/77.1; 220/85 H

[56] References Cited

U.S. PATENT DOCUMENTS

| | | | |
|---|---|---|---|
| D. 121,813 | 8/1940 | Isenberg | D6/537 |
| D. 167,234 | 7/1952 | Simpson | D6/537 |
| 1,219,370 | 3/1917 | Bray | 206/77.1 |
| 1,358,540 | 11/1920 | Goodwin | 206/77.1 X |
| 1,554,832 | 9/1925 | Antelmann | 206/77.1 |
| 1,905,069 | 1/1929 | Stair | 248/206.3 |
| 2,044,520 | 1/1935 | Weiant, Jr. . | |
| 2,309,121 | 10/1940 | Keely . | |
| 2,457,918 | 1/1949 | Pierce | 206/77.1 |
| 2,465,050 | 3/1949 | Zawadzki | 206/77.1 X |
| 2,704,907 | 3/1955 | Durkee | 206/77.1 |
| 2,825,177 | 3/1958 | Nordlof et al. | 248/683 X |
| 3,019,549 | 11/1959 | Evans . | |
| 3,177,048 | 4/1965 | Whatley | 248/311.2 X |
| 3,750,991 | 8/1973 | Ragir . | |
| 4,376,521 | 3/1983 | Walters . | |
| 4,588,075 | 5/1986 | Rupp | 206/77.1 |
| 4,654,901 | 4/1987 | Garcia | 206/77.1 X |

*Primary Examiner*—Ramon O. Ramirez

*Attorney, Agent, or Firm*—Adrian D. Battison; Stanley G. Ade; Murray E. Thrift

[57] ABSTRACT

A portable soap container comprises a dish portion with a hinged fastenable lid. On one side wall of the dish portion is mounted three suction cups which allow the side wall to be fastened to a vertical wall for example of a shower. A bracket member is pivotally mounted on the underside of the container and moveable from a stored position in which it lies alongside the undersurface of the container to an operating position in which it depends downwardly from the undersurface to define a contact portion which engages the wall beneath the suction cups to prevent the weight of the container twisting the suction cups off the wall.

15 Claims, 2 Drawing Sheets

PORTABLE CONTAINER FOR SOAP

The present invention relates to a portable container for soap of a type which can be used to transport a soap bar and which can also be mounted on a shower wall for supporting the soap bar when used for washing.

Many people after indulging in sporting activities take a shower in the facilities provided at the location where the sporting activities take place. In some cases soap is provided at the shower facilities but for reasons of hygiene many people prefer not to use communally provided soap. Plastic containers are available for transportation of soap so the soap can be enclosed and protected while it is carried for example in the equipment bag. However these containers are merely for transportation and when the soap is removed for use in the shower do not in any way assist in supporting the soap for use within the shower and this leaves the user either to hold the soap during the whole time or to place the soap on the floor or to place the soap in a container provided for this purpose but that of course interferes with the intention of maintaining the soap in a hygienic condition since the container is necessarily a communal one.

Many designs of soap containers have been provided previously and examples are shown in U.S. Pat. Nos. Des. 167,234 (Simpson), 121,813 (Isenverg) and in U.S. Pat. Nos. 2,044,520 (Weiant), 2,309,121 (Keely), 3,019,549 (Evans), 1,905,069 (Stair) and 4,588,075 (Rupp). One example of a suction device as shown in U.S. Pat. No. 3,750,991 (Ragir) and a bracket for supporting a glass shelf is shown in U.S. Pat. No. 4,376,521 (Walters). The soap dishes shown in the patents above are however not suitable for the purposes of the present invention in that they either do not act as a container for the soap or the container is not in any way transportable.

SUMMARY OF THE INVENTION

It is one object of the present invention, therefore, to provide a portable container for soap which is readily transportable in that it can be readily contained within for example an equipment bag used for sporting activities and in addition it can be attached to a shower wall for supporting the soap when it is intended to be used in the shower.

According to a first aspect of the invention, therefore, there is provided a portable container for soap comprising a dish portion defining a receptacle having a support surface into which a bar of soap can be placed for resting on the support surface, a cover member for the dish portion arranged to be moveable from a closed position defining with the dish portion a substantially closed enclosure for the bar of soap to an open position in which the bar can be manually grasped and removed for use, suction mounting means positioned on one side of the dish portion, the suction mounting means including at least one suction cup arranged for connection to a wall surface lying substantially at right angles to the support surface of the dish portion to attach the dish portion onto the wall surface, and a bracket member mounted on the dish portion and moveable relative thereto from a first position in which the bracket member defines a wall engaging portion for engaging the wall surface at a position beneath the suction mounting means to prevent pivotal movement of the dish portion about a horizontal axis at the suction mounting means to a second position in which the bracket member lies substantially flat against the undersurface of the dish portion.

According to a second aspect of the invention there is provided a portable container for soap comprising a dish portion defining a receptacle having a support surface into which a bar of soap can be placed for resting on the support surface, a cover member for the dish portion, from a closed position defining with the dish portion substantially closed enclosure for the bar of soap to an open position in which the bar can be manually grasped and removed for use, suction mounting means positioned on one side of the dish portion, the suction mounting means including a plurality of suction cups arranged for connection to a wall surface lying substantially at right angles to the support surface of the dish portion to attach the dish portion onto the wall surface, and means mounted on the dish portion for engaging the wall surface at a position beneath the suction mounting means to prevent pivotal movement of the dish portion about a horizontal axis at the suction mounting means.

The container according to the invention therefore provides a complete container which can surround and protect the soap from contacting other materials in the equipment bag or the like even when roughly handled and transported. When removed, however, the container can be readily attached to a shower wall by suction cups with the bracket member being used in the supporting position to prevent the weight of the container twisting the suction cups away from the wall while the bracket member can be stored in a retracted position during transportation.

The container is therefore simple and inexpensive to manufacture, rugged and easy to transport and yet enables the user to carry and support his own soap for hygienic use.

With the foregoing in view, and other advantages as will become apparent to those skilled in the art to which this invention relates as this specifications proceeds, the invention is herein described by reference to the accompanying drawing forming a part hereof, which includes a description of the best mode known to the applicant and of the preferred typical embodiment of the principles of the present invention, in which:

DESCRIPTION OF THE DRAWING

In the drawings like characters of reference indicate corresponding parts in the different figures.

DETAILED DESCRIPTION

Figure 3:
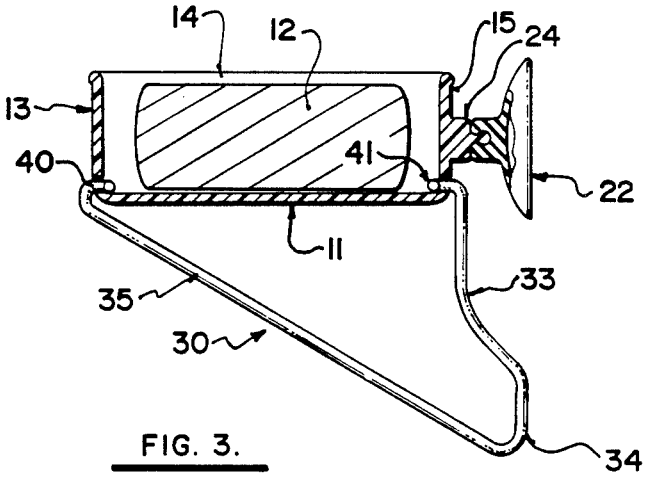
FIG. 3 is a cross-sectional view basically along the lines 3—3 of FIG. 2 but showing a modified arrangement.

The soap container according to the invention comprises a dish portion 10 defined by a base 11 which is in use substantially horizontal for supporting a bar of soap 12. The dish portion includes four upstanding sides 13, 14, 15 and 16. At the top edge of one of the side walls indicated at 14 is attached a lid 16 in the form of a substantially flat panel with downturned edges 17 which can mate in a snap-fit connection with upper edges of the side walls 13, 14, 15 and 15A so that the cover can move to a closed position (not shown) in which the container is substantially fully closed to enclose the soap bar 12. In addition the lid can be moved to an open position shown in the drawings in which the container is open to allow the user to manually reach into the dish portion to remove the soap bar 12.

A dividing wall 18 is provided in the dish portion so the soap bar 12 is stored on one side of the dividing wall and on the other side of the dividing wall is an area sufficient to receive a small container of shampoo.

In the closed position of the lid the lid is snap-fit in connection with the dish portion to effectively prevent leakage of any water or moisture from the container and to prevent the soap from contacting or contaminating any surrounding materials when the container is thrown for example into an equipment bag.

The lid portion 16 is preferably molded integrally with the dish portion so that the lid portion remains permanently attached to the dish portion with the hinge line being defined by a molded portion of the plastics material which is thinner than the dish portion and lid portion to allow the hinging action. Preferably the hinge is arranged to bias the lid portion t the opened position in which it preferably extends horizontally from the dish portion for receiving, for example, rings and other valuables separately from the dish portion.

A mounting system by which the container can be attached to a shower wall or the suitable vertical surface comprises a suction mounting means generally indicated at 20 including three suction cups 21, 22 and 23. The suction cups define an attachment face which is at right angles to the base surface 11 so that the attachment face can be attached directly to a vertical wall and hold the container with the base surface substantially horizontal. The suction cups 22 are suitably attached to the side surface 15 of the dish portion by way of molded connecting elements 24 to which the flexible suction cups 22 are fastened. Preferably the connection elements 24 are integrally molded with the dish portion so that the unit can be assembled simply by pressing the suction cups which are of course commercially available into place onto the side wall 15 of the dish portion.

In order to prevent the weight of the container including the soap and any other materials placed into the container from twisting the container about a line passing through the suction cups and thus twisting the suction cups so that the upper edges of the suction cups are pulled away from the wall surface, a bracket member 30 is provided on the underside of the container. The bracket member is a separate element which is formed by molding to form a substantially rigid triangular form. The bracket member 30 includes an upper rail 31 which can project into recesses or clips 32 on the undersurface of the base wall 11 of the dish portion to allow the bracket member to pivot about a horizontal axis defined through the clips 32. From the rear end of rail 31, a rear rail 33 of the bracket member 30 depends downwardly and slightly rearwardly to define an apex 34 which lies substantially in the plane of the suction cups 21, 22 and 23 so that the apex 34 can contact the wall at a position beneath the suction cups. A supporting strut 35 extends from the apex 34 towards the front end of the rail 31. The bracket member 30 is shaped so that it can take up a position shown in FIGS. 2 and 3 in which the apex is arranged beneath the suction cups for contacting the wall. In this position the twist of the container caused by the weight of the container is prevented and the force on the suction cups is simply a force away from the wall surface which the suction cups can accommodated without breaking away from the wall surface. A stop 39 is provided on one side of the bracket to prevent the bracket pivoting to a position beyond the right angle position.

Figure 1:
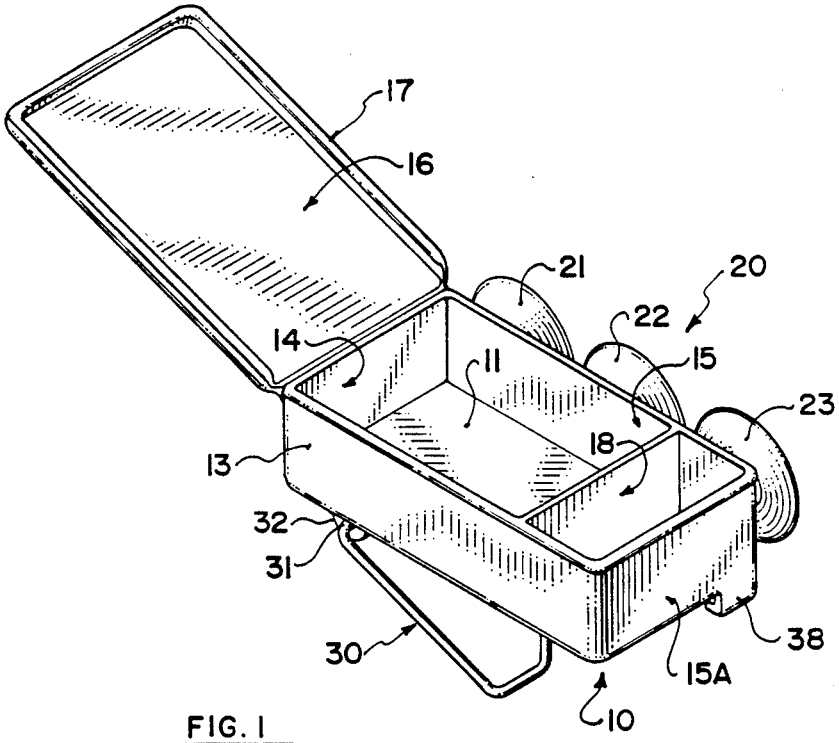
FIG. 1 is an isometric view of a portable container for soap according to the invention.
Figure 2:
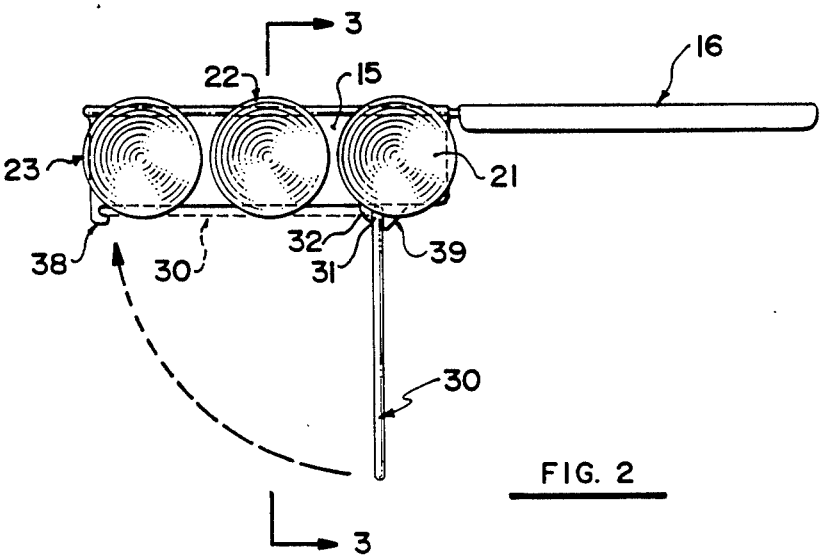
FIG. 2 is a rear elevational view of the container of FIG. 1.

In the position shown in phantom line in FIG. 2 and in the position shown in FIG. 1, the bracket member 30 is moved into a folded condition in which it lies alongside the undersurface of the base 11. In this position the container forms substantially merely a rectangular container of a size just slightly larger than the soap bar which it is intended to contain which is suitable for transportation and storage in an equipment bag of the type which might be carried to sporting activities. A latch member 38 is provided on the undersurface of the container to latch the bracket member in place in the folded condition. As shown in FIG. 2, the bracket member is slightly offset from the center of the container so that the bracket member is contained wholly within the undersurface of the dish portion in the folded folded condition and yet provides sufficient distance of the apex 34 down the wall to properly accommodate the forces applied by the container to the wall.

In FIG. 3, the clips 32 are omitted and the bracket 30 is formed of a bent wire member. The bracket includes pins 40 and 41 which project into recesses in the side walls of the dish portion adjacent the base surface. The wire is cranked adjacent the pins to allow the bracket to fold flat against the undersurface of the dish portion and also to prevent the bracket moving beyond 90° in the opened position.

Since the various modifications can be made in my invention as hereinabove described, and many apparently widely different embodiments of same made within the spirit and scope of the clams without departing from such spirit and scope, it is intended that all matter contained in the accompanying specification shall be interpreted as illustrative only and not in a limiting sense.

I claim:

1. A portable container for soap comprising a dish portion defining a receptacle having a support surface into which a bar of soap can be placed for resting on the support surface, a cover member for the dish portion arranged to be moveable from a closed position defining with the dish portion substantially closed enclosure for the bar of soap to an open position in which the bar can be manually grasped and removed for use, suction mounting means positioned on one side of the dish portion, the suction mounting means including at least one suction cup arranged for connection to a wall surface lying substantially at right angles to the support surface of the dish portion to attach the dish portion onto the wall surface, and a bracket- member mounted on the dish portion and moveable relative thereto from a first position in which the bracket member .defines a wall engaging portion for engaging the wall surface at a position beneath the suction mounting means to prevent pivotal movement of the dish portion about a horizontal axis at the suction mounting means to a second position in which the bracket member lies substantially flat against the undersurface of the dish portion.

2. The invention according to claim 1 including hinge means mounting the cover portion on the dish portion such that the cover portion remains attached to the dish portion in the open position thereof.

3. The invention according to claim 2 wherein the hinge means is mounted along one side of the dish portion substantially at right angles to the side on which the suction mounting means is positioned.

4. The invention according to claim 1 wherein the dish portion comprises a substantially flat sup port surface and a plurality of substantially vertically extending side walls defining a receptacle of sufficient depth to receive a soap bar.

5. The invention according to claim 4 wherein the suction mounting means is attached to and extends directly outwardly from one of said side walls.

6. The invention according to claim 1 wherein the bracket member comprises a substantially planar body pivotally mounted on the dish portion about an axis lying in the plane of the body and extending substantially at right angles to said wall surface.

7. The invention according to claim 6 wherein the pivot is closely adjacent the support surface of the dish portion.

8. The invention according to claim 7 wherein the dish portion, cover portion and bracket member are arranged as in the closed and folded positions thereof, the container forms a body which is relatively transportable.

9. The invention according to claim 1 wherein the dish portion includes a compartment for containing shampoo.

10. A portable container for soap comprising a dish portion defining a receptacle having a support surface into which a bar of soap can be placed for resting on the support surface, a cover member for the dish portion, from a closed position defining with the dish portion substantially closed enclosure for the bar of soap to an open position in which the bar can be manually grasped and removed for use, suction mounting means positioned on one side of the dish portion, the suction mounting means including a plurality of suction cups arranged for connection to a wall surface lying substantially at right angles to the support surface of the dish portion to attach the dish portion onto the wall surface, and means mounted on the dish portion for engaging the wall surface at a position beneath the suction mounting means to prevent pivotal movement of the dish portion about a horizontal axis at the suction mounting means.

11. The invention according to claim 10 wherein the hinge means is mounted along one side of the dish portion substantially at right angles to the side on which the suction mounting means is positioned.

12. The invention according to claim 10 wherein the cover member lies in a horizontal position in the open position thereof.

13. The invention according to claim 10 wherein the dish portion comprises a substantially flat support surface and a plurality of substantially vertically extending side walls defining a receptacle of sufficient depth to receive a soap bar.

14. The invention according to claim 13 wherein the suction mounting means is attached to and extends directly outwardly from one of said side walls.

15. The invention according to claim 10 wherein the dish portion includes a compartment for containing shampoo.

* * * * *